US007490360B2

(12) United States Patent
Meadows

(10) Patent No.: US 7,490,360 B2
(45) Date of Patent: Feb. 17, 2009

(54) KNEEPADS ATTACHABLE TO PANTS FABRIC WITH LOCKING CLIPS

(76) Inventor: Dexter Meadows, P.O. Box 81942, Bakersfield, CA (US) 93380-1942

( * ) Notice: Subject to any disclaimer, the term of this patent is extended or adjusted under 35 U.S.C. 154(b) by 196 days.

(21) Appl. No.: 11/529,965

(22) Filed: Sep. 29, 2006

(65) Prior Publication Data

US 2008/0115248 A1 May 22, 2008

(51) Int. Cl.
*A41D 13/00* (2006.01)

(52) U.S. Cl. ..... 2/23

(58) Field of Classification Search ..... 2/23, 2/24, 267, 79, 227, 268, 69
See application file for complete search history.

(56) References Cited

U.S. PATENT DOCUMENTS

| | | | | |
|---|---|---|---|---|
| 891,533 | A * | 6/1908 | Gibbs | 2/24 |
| 2,561,872 | A * | 7/1951 | Krinick | 2/24 |
| 3,346,877 | A * | 10/1967 | Zirves | 2/24 |
| 6,704,938 | B2 * | 3/2004 | Crockett | 2/23 |

* cited by examiner

*Primary Examiner*—Tejash Patel
(74) *Attorney, Agent, or Firm*—Donald W. Meeker

(57) ABSTRACT

A knee pad with locking clips adjustable straps clip onto the pants of the wearer at the sides of the knees, with no uncomfortable strap encircling the leg. Clip lock rings slide over spring clips to lock them, thereby retaining the knee pad attached to the pant leg under all conditions of use.

19 Claims, 10 Drawing Sheets

KNEEPADS ATTACHABLE TO PANTS FABRIC WITH LOCKING CLIPS

CROSS-REFERENCE TO RELATED APPLICATIONS

Not Applicable.

STATEMENT REGARDING FEDERALLY SPONSORED RESEARCH OR DEVELOPMENT

Not Applicable.

THE NAMES OF THE PARTIES TO A JOINT RESEARCH OR DEVELOPMENT

Not Applicable.

BACKGROUND OF THE INVENTION

1. Field of the Invention

The present invention relates to knee pads and in particular to knee pads with clips on adjustable straps which clip onto the pants of the wearer at the sides of the knees with no uncomfortable strap encircling the leg and which employ locking clips which retain the knee pads attached to the pants under all conditions of use.

2. Description of Related Art Including Information Disclosed Under 37 CFR 1.97 and 1.98

Knee pads are essential equipment for users engaged in activities requiring contact of the knees with the ground or other surfaces. Under extreme conditions involving strenuous activity, especially in hot climates, knee pads with straps encircling the leg of the user can become very uncomfortable, cut off circulation, cut off air flow, and cause perspiration and irritation and rubbing which may cause rashes to a back of the leg of the user, especially in the sensitive area behind the knee where such encircling straps often rub. The around the knee straps on prior art kneepads often loosen and slip down the leg to expose the knee to injury because they cannot be extremely tight or the user won't have full mobility.

Knee pads must be very durable with combined hard outer shell and soft inner padding to protect the knee of the wearer in adverse use conditions, especially in combat. The knee pads must stay in place without falling off and without moving from the shielding position covering the knee cap of the user to protect the knee of the user adequately. Prior art knee pads do not provide knee pads which adequately address all of the requirements of knee pads used in adverse conditions.

Prior art U.S. Pat. No. 6,704,938, issued Mar. 16, 2004 to Crockett, provides a method and apparatus for attachment of protective pads. A plurality of fasteners is attached spaced around the periphery of a pad, such as a knee or elbow pad, with the fasteners being capable of gripping the ordinary clothing of a worker to secure the pad at the joint to be protected. The fasteners do not damage to material of the clothing, secure the pad in place at all times, and are readily attached to and detached from any ordinary street and/or work clothing. No modification of the clothing is required.

Prior art U.S. Pat. No. 3,346,877, issued Oct. 17, 1967 to Zirves, is for a typical clip-on knee pad having a plurality of alligator clips which secure the pad to the user's pants leg.

Prior art U.S. Pat. No. 6,347,403, issued Feb. 19, 2002 to Wilcox, shows a protective knee system for attaching a pair of knee pads to pair of pants to protect the wearer's knees. The protective knee system includes a pair of pants. The pair of pants is comprised of a pair of leg portions that includes a first panel, a second panel, an inseam and a side seam. There is a plate that includes a first surface and a second surface. There is also a panel that includes a front side, a back side, a top edge, a bottom edge and a pair of side edges. The plate is integrally attached to the front side of the panel. There is a fastening means for securing the panel to the pair of pants such that the pair of side edges of the panel are removably coupled to the inseam and the side seam of the pair of pants.

Prior art U.S. Pat. No. 4,561,123, issued Dec. 31, 1985 to Hull, describes a knee-pad device characterized by a flexible, arcuate pad member attached both above and below the knee. When the person using the knee pad device is standing, the pad member bows away from the knee to allow air to flow around the knee. When the person is kneeling, the pad member conforms to the shape of the knee. The pad member can be attached either to the legs of a pair of pants, or to a pair of straps which encircle a user's legs.

Prior art U.S. Pat. No. 5,592,689, issued Jan. 14, 1997 to Matthews, discloses a sound-emitting knee pad apparatus that includes a pad assembly which emits a sound when located between a knee of an infant person and a floor surface when the person is crawling on the floor surface. A pad connector assembly connects the pad assembly to a knee of the person or to an outside surface of a knee-juxtaposed region of a garment worn by the person. The pad connector assembly includes a first connector assembly attached to an outside surface of a knee-juxtaposed region of a garment. A second connector assembly is attached to an outside surface of the pad assembly. The first connector assembly is a quantity of hook-or-loop connector material. The second connector assembly is a quantity of complementary loop-or-hook connector material. The pad assembly may be comprised of a rubber material. Alternatively, the pad assembly may include an air chamber assembly which includes a plurality of resilient exterior walls which define an interior air chamber. A whistle assembly is supported by one of the resilient exterior walls. The whistle assembly provides an air communication path between the interior air chamber and air outside the interior air chamber. The pad connector assembly may include a strap assembly which includes a first end connected to a first side of the pad assembly and includes a second end connected to a second side of the pad assembly. The strap assembly is comprised of elastic resilient material.

Prior art U.S. Pat. No. 5,611,081, issued Mar. 18, 1997 to Torres, puts forth work pants in which padding is provided to protect both the knees and shins of the worker. In one form of the invention, the knee protective padding and the shin protective padding comprise separate components which are independently receivable within specially configured pockets provided in the work pants.

Prior art U.S. Pat. No. 4,893,355, issued Jan. 16, 1990 to Ritter, concerns a knee protector that covers the front of the knee and extends rearwardly on both sides to protect against mechanical damage to the knee. The protector has foamed padding towards the leg for both comfort and mechanical protection, and a somewhat rigid outer shell to provide strength. For comfort as the leg is flexed, the front of the knee protector has a line about which the rigid shell can move, so that two sections of the shell are articulated, allowing movement in all directions. One side of the knee protector can be shortened to allow the use of a knee splint in conjunction with the knee protector.

Prior art U.S. Pat. No. 6,421,839, issued Jul. 23, 2002 to Vo, indicates work pants which include at least one pant leg and a pocket in the area of the knee. Within each pocket is to be located a cushioning pad. The cushioning pad is to be inserted through an access opening which has a length smaller than the width of the knee pocket which tends to prevent accidental dislodgment of the pad from the knee pocket. A securement device is to be connectable between the pad and the pant leg of the work pant. The knee pocket may be covered by a covering sheet to hopefully prevent the forming of wear holes within the knee area of the work pant.

Prior art U.S. Pat. No. 6,317,888, issued Nov. 20, 2001 to McFarlane, illustrates a knee pad including a multiple layer elongate member conformed to fit over a knee. The middle layer comprises a rigid polymeric material with projecting arms that encircle the leg and clasp the knee pad thereon. An inner cushion layer and an outer semi rigid layer enhance the comfort of the knee pad. The flexible arms include a supplemental reinforcing rib and the arms are positioned so as to support the knee pad by engaging the leg of a wearer below the knee.

Prior art U.S. Pat. No. 2,561,872, issued Jul. 24, 1951 to Krinick, provides a snap-on knee protector pad for overalls and other garments. An alternate embodiment is shown wherein the knee pad is attached to the trouser leg by clips.

What is needed is a knee pad with inner padding and a hard outer shell having clips each attached to an adjustable tightening strap which clip to the sides of the pants and clip lock rings to lock the clips in place.

BRIEF SUMMARY OF THE INVENTION

An object of the present invention is to provide a knee pad with inner padding and a hard outer shell, which is preferably flexible, having spring loaded clips each attached to an adjustable tightening strap which clip to the sides of the pants, not encircling the pants, and clip lock rings to lock the clips in place to provide rugged locked on knee protection without irritating the back of the knee.

A related object of the present invention is to provide rubber coated clips with overlapping teeth on each clip to bind the material without piercing it so that the clips hold securely without tearing the material.

Another related object of the present invention is to provide a large padded underside and a smaller hard outer shell with some flexibility covering just the kneecap for full kneecap protection in a flexible knee pad.

Another object of the present invention is to provide a kneepad which secures just to the sides of the pants without encircling the pants so that the kneepads may stay on the pants when the pants are removed from the wearer and the pants may be put on by the wearer with the kneepads in place.

An added object of the present invention is to provide strips of rip-proof rubber coated material attached to the kneepads under the locking clips which material fits between the jaws of the locking clips and the pants fabric to insure that the pants fabric does not rip or puncture.

Another added object of the present invention is to provide a bullet proof pad inserted behind the kneepad to prevent ballistic penetration to the knee.

One further object of the present invention is to provide an elongated padding insert which fits within an elongated kneepad sleeve to protect both the knees and shins of the wearer.

Still another object of the present invention is to provide a small padded insert which fits within a shortened kneepad sleeve that may be used either as a kneepad or an elbow pad.

An alternate object of the present invention is to provide a kneepad with a pair of locking clips at the top for engaging material on a pair of shorts worn by the user and a soft leg encircling adjustable bottom strap to encircle the bare leg of the wearer below the knee.

In brief, a knee pad with inner padding and a hard flexible outer shell has spring loaded clips each attached to an adjustable tightening strap. The spring loaded clips each clip to the side of a pants leg and are provided with clip lock rings to lock the clips in place, thereby providing locking clips for rugged locked-on knee protection without irritating the back of the knee. The kneepad preferably secures just to the sides of the pants without encircling the pants leg so that the kneepads may stay on the pants when the pants are removed from the wearer and the pants may be put on by the wearer with the kneepads in place. Rubber coated clips are provided with overlapping teeth on each clip to bind the pants leg material without piercing it so that the clips hold securely without tearing the material. The knee pad comprises a large padded underside and a smaller hard flexible outer shell with some flexibility covering just the kneecap for full kneecap protection in a flexible knee pad.

Alternately, the kneepad may further comprise a covering strip of material loosely encircling a leg of a user over each of the pair of locking clips to shield the locking clips. Each covering strip of material comprises a one or two-part overlapping strip of material extending from each of two opposing sides of the kneepad and interconnected by mating hook and loop fasteners.

A further alternate embodiment comprises a shin padding material extending from a bottom of the kneepad for covering a shin of a wearer and further comprising at least one additional pair of locking clips extending from two opposing bottom edges of the shin padding material. This alternate embodiment further may comprise a sleeve covering the kneepad and shin padding material.

The lock on kneepads of the present invention can used by almost everyone, including construction workers, soldiers, police tactical officers and those involved in intense tactical training.

An advantage of the present invention is that user's leg is not constricted.

Another advantage of the present invention is the knee pad is held securely without tearing the fabric of the pants leg.

One more advantage of the present invention is that the knee pad stays locked in its proper place, covering the knee.

An additional advantage of the present invention is that it may also provide shin coverage.

A further advantage of the present invention is that it provides protection to the knee, while allowing flexible movement of the knee joint.

A contributory advantage of the present invention is the knee pad may remain attached to the pants while the pants are not in use.

Yet another advantage of the present invention is that the clip locks may be further secured by an auxiliary clip covering strap.

BRIEF DESCRIPTION OF THE SEVERAL VIEWS OF THE DRAWINGS

These and other details of my invention will be described in connection with the accompanying drawings, which are furnished only by way of illustration and not in limitation of the invention, and in which drawings.

DETAILED DESCRIPTION OF THE INVENTION

In FIGS. 1-15, a kneepad device 20 and 20A-20F with locking clips 21 attaches to the sides of pant leg fabric 41 to lock the kneepad device 20 and 20A-20F in place on the pant leg 40. The kneepad device 20 and 20A-20F is structured to fit over a knee of a wearer to protect the knee.

Figure 2:
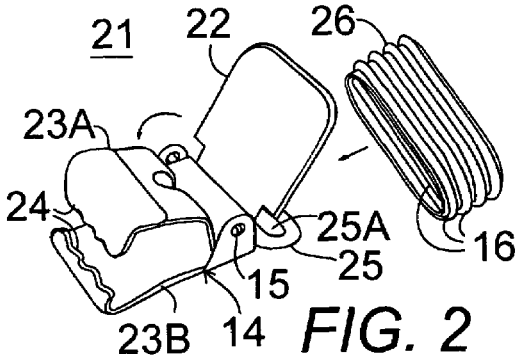
FIG. 2 is a perspective view of a spring loaded clip of FIG. 1 in an open position with a locking loop aligned for installation on the spring loaded clip.

The kneepad device 20 and 20A-20F comprises a top pair of locking clips 21 extending from two opposing top edges of the kneepad 27 and a bottom pair of locking clips 21 extending from two opposing bottom edges of the kneepad 27. Each of the locking clips 21 comprises a spring loaded clip 14 having a pair of jaws 23A and 23B pivotally attached together by a spring loaded pivot pin 15 at a proximal end and a clip control plate 22 for opening and closing the jaws 23A and 23B, as shown in FIG. 2. The jaws 23A and 23B each have a means for engaging pants material 41 at a distal end, preferably overlapping teeth 24 so that the jaws 23A and 23B are pivotable together in a closed position with the jaws 23A and 23B of the top pair of locking clips 21 engaging pants material 41 on each side of a pants leg 40 above a knee of a user and the jaws 23A and 23B of the bottom pair of locking clips 21 engaging pants material 41 on each side of a pants leg 40 below a knee of a user.

The means for engaging pants material 41 comprises an array of teeth 24 extending orthogonally from a distal end of one of the pair of jaws 23A misaligned and overlapping with an array of teeth 24 extending orthogonally from the distal end of the other of the pair of jaws 23B with the teeth 24 of the pair of jaws overlapping 23A and 23B each other in close proximity in the closed position so that the overlapping teeth 24 grip the pants material 41 with a tight friction fit without piercing the pants material 41. The locking clips 21 comprises a pair of jaws 23A and 23B coated with a rubberized material at least on the teeth 24 to create a high friction surface to prevent slippage with the pants material 41 and with smooth rounded edges to prevent tearing the pants material.

Figure 4:
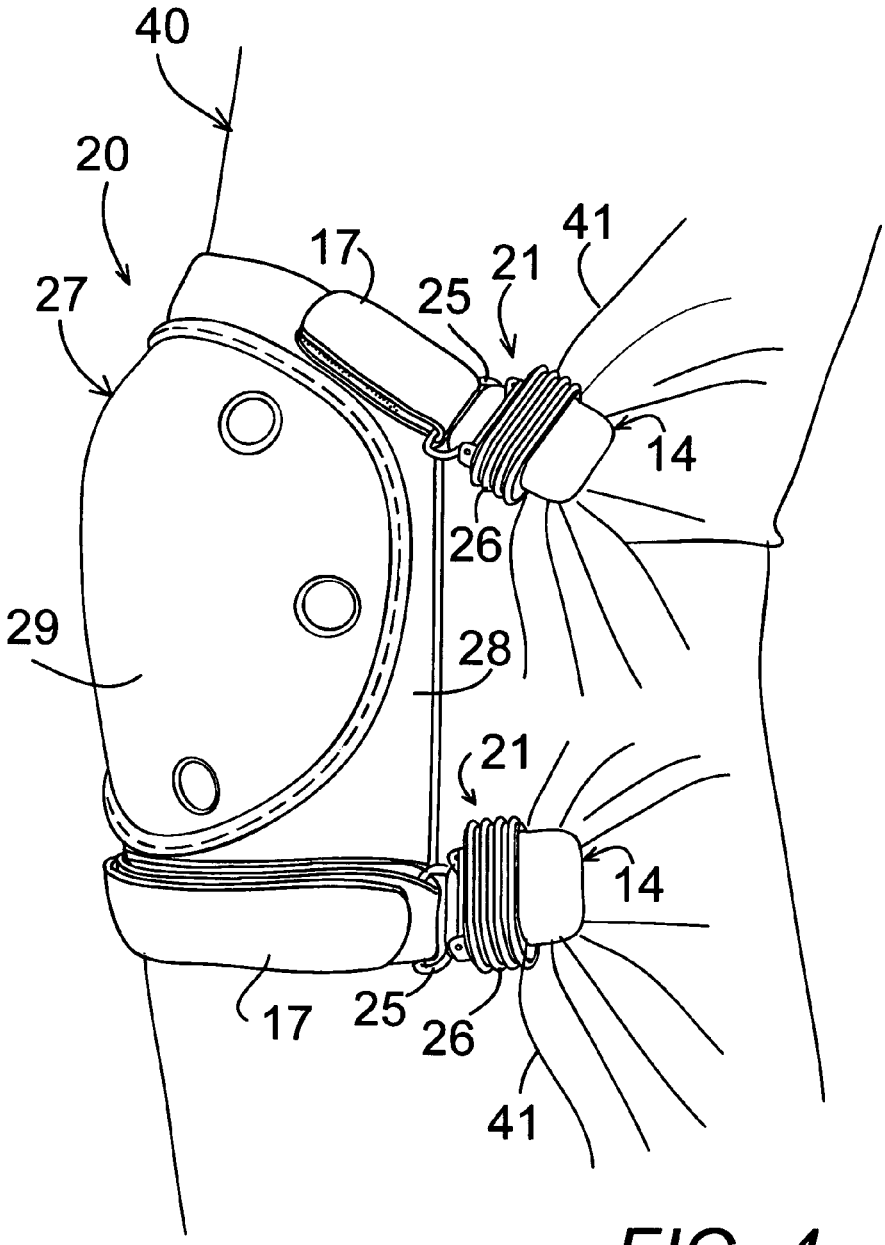
FIG. 4 is a side elevational view of the kneepad device of FIG. 1 attached to a pant leg at the knee showing two locking clips locked onto the pants material.

The locking clips 21 also comprise a clip locking loop 26 slidably attached to each of the spring loaded clips 14. The clip locking loop 26 has a high friction outer surface and is configured to slide over the spring loaded clip 14 encircling the clip control plate 22 and the pair of jaws 23A and 23B of the clip 14 with the pair of jaws 23A and 23B in the closed position engaging the pants material 41 to lock the jaws 23A and 23B closed over the material 41, thereby forming a locking clip 21 to lock the kneepad 27 onto the pants 41, as shown in FIG. 4.

Figure 1:
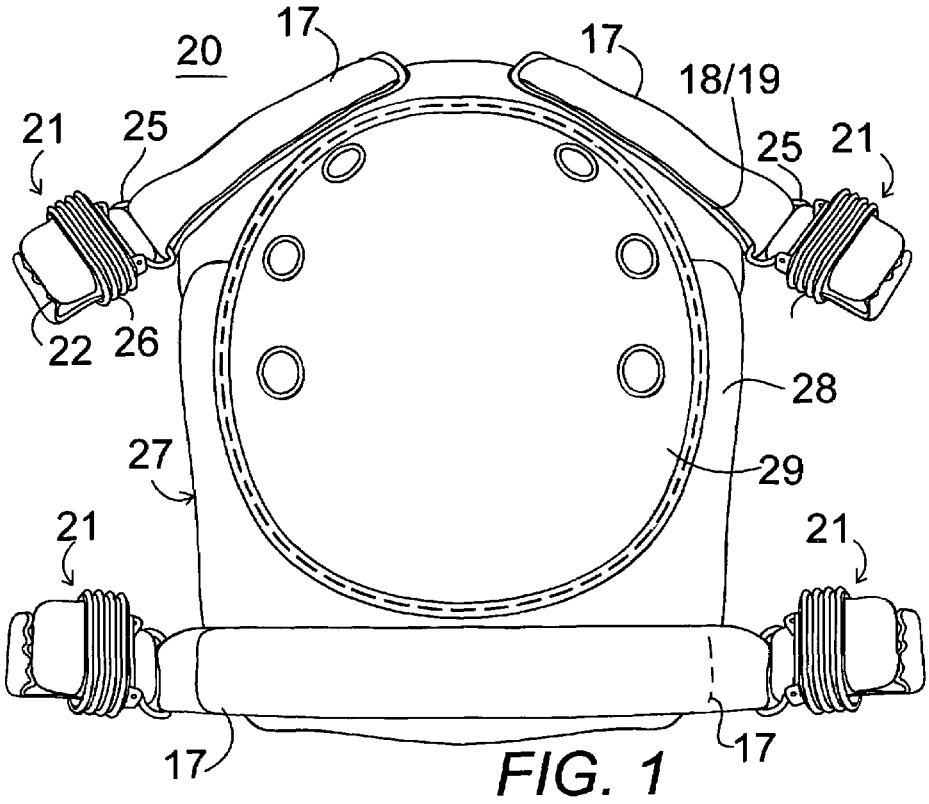
FIG. 1 is a front elevational view of the kneepad device of the present invention showing two pair of attached locking clips.

The clip locking loop 26 comprises a closed loop 26 of strong material coated with an outer resilient rubberized high friction surface or entirely fabricated of a rubberized material, preferably an oval loop 26 coated with a rubberized surface and having a series of ridges 16 inside the loop 26 to engage the spring clip 14 and a series of ridges 16 outside the loop 26 for gripping to move the clip locking loop 26 to lock and unlock the spring clip 14. The loop 26 has an inner perimeter mating with and slightly smaller than the outer perimeter of the spring clip 14 so that the outer resilient rubberized surface stretches to enable the clip locking loop 26 to slide over the spring clip 14 and to remain around the spring clip 14 with a high tension fit enhanced by the high friction surface to secure the clip locking loop 26 around the spring clip 14, the two combined forming the locking clip 21, as shown in FIGS. 1, 3 and 4.

Figure 3:
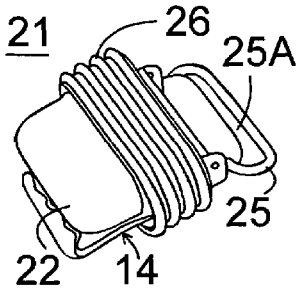
FIG. 3 is a perspective view of a spring loaded clip of FIG. 1 in a closed position with a locking loop installed on the spring loaded clip to form in combination a locking clip.

In FIGS. 2 and 3, each of the spring clips 14 further comprises a strap attaching element 25 attached to the proximal end of the spring clip 14. The strap attaching element 25, in this case a metal ring, has a slot opening 25A therein. The adjustable length strap 17 comprises an elongated strap 17 having a proximal strap end attached to the kneepad 27 and a distal strap end inserted through the slot opening 25A and overlapping itself to form an overlapping section of the elongated strap 17 with a pair of mating hook and loop fasteners 18 and 19 attached to the elongated strap 17 for securing the overlapping section of the elongated strap 17 together so that the elongated strap 17 is adjustable to any desired length to form a tight attachment of the kneepad device 20 and 20A-20F to the pants 40.

In FIGS. 1-6 and 10-13, the kneepad 27 of the device 20, 20A, and 20C-20E comprises a large padded underside 28 and 28A in contact with the pants 40 of the wearer and a smaller hard outer shell 29 with some flexibility covering just the kneecap for full kneecap protection in a flexible knee pad.

Figure 5:
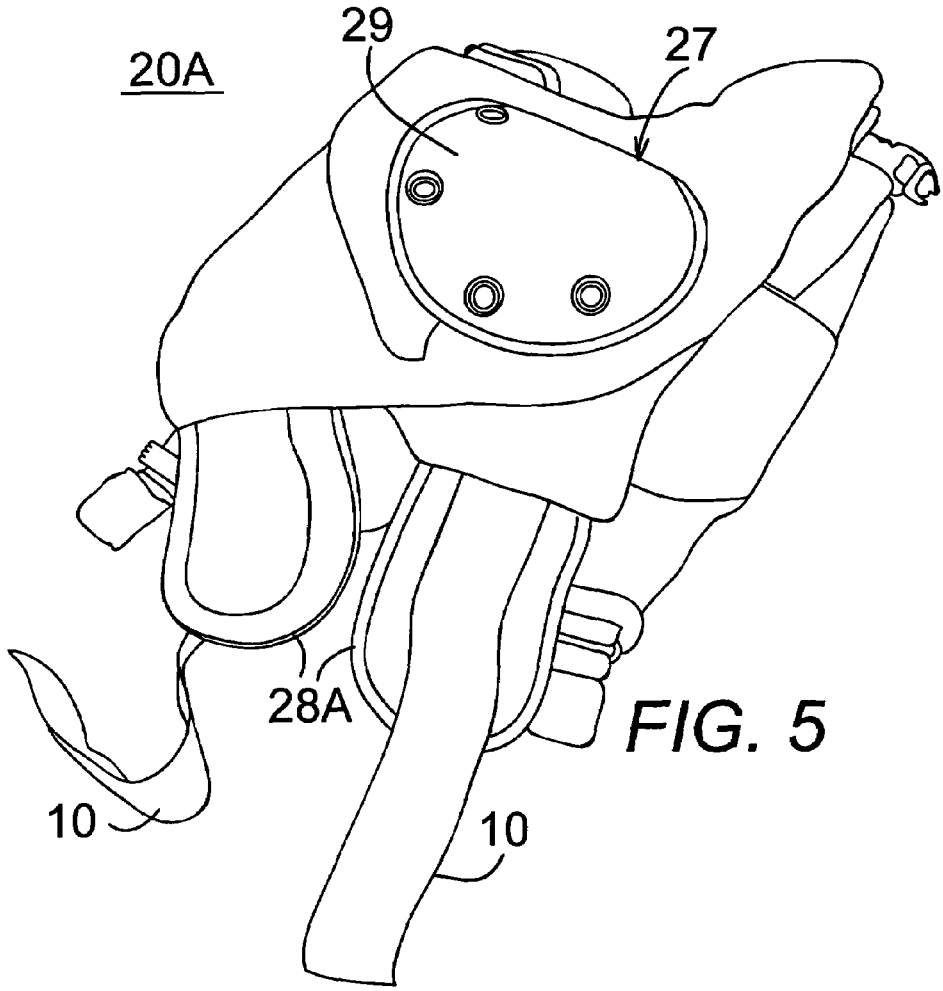
FIG. 5 is a perspective view of an alternate embodiment of the kneepad device of the present invention having extra wide padding material and a cover strap over each of the pairs of locking clips.
Figure 6:
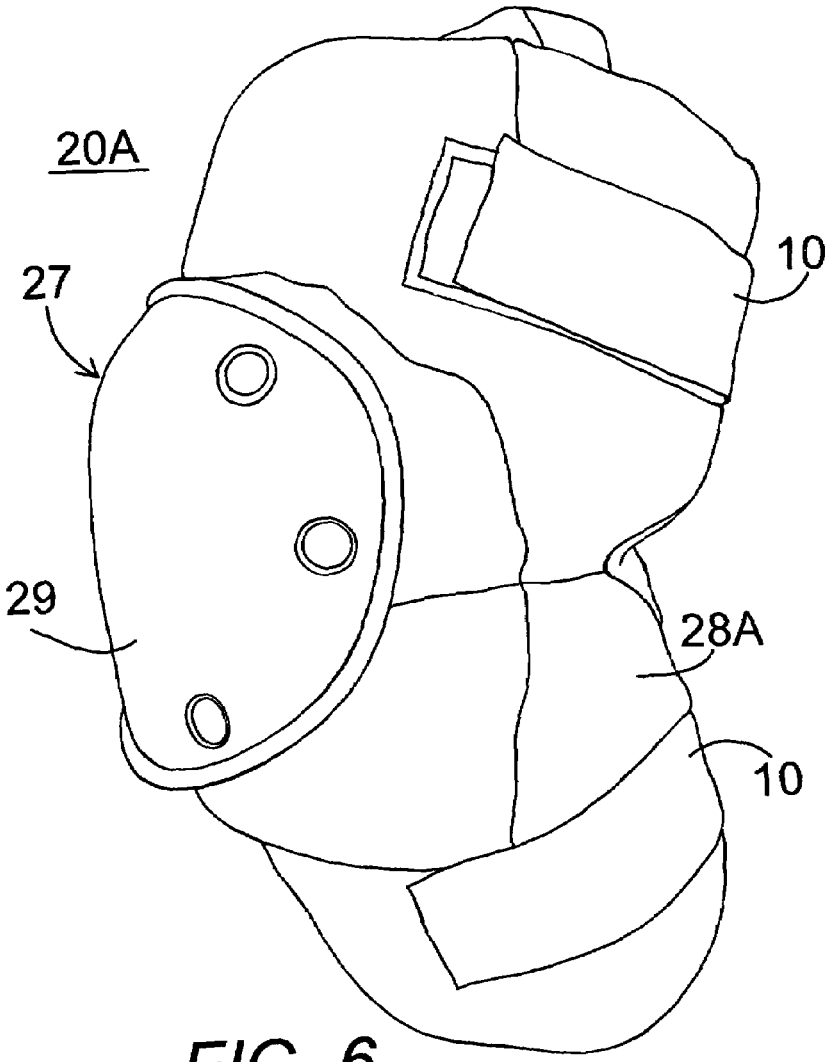
FIG. 6 is a side elevational view of the alternate embodiment of the kneepad device of FIG. 5 having extra wide padding material and a cover strap over each of the pairs of locking clips with the device installed on a knee of a wearer.

In FIGS. 5 and 6, the kneepad device 20A may comprise an extended padding 28A and a covering strip of material 10 loosely encircling a leg of a user over each of the pair of locking clips 21 to shield the locking clips 21. Each covering strip of material 10 comprises a one-part or two-part overlapping strip of material extending from each of two opposing sides of the kneepad 20A and interconnected by mating hook and loop fasteners.

Figure 7:
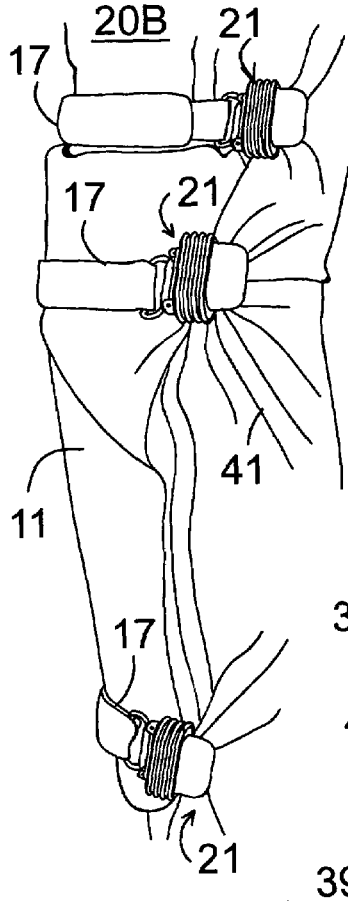
FIG. 7 is a side elevational view of another alternate embodiment of the kneepad device of the present invention having a bottom extension shin padding with the entire padding covered in a sleeve with the adjustable straps of the locking clips attached to the exterior of the sleeve and including an additional bottom pair of locking clips at the bottom of the shin padding with the kneepad device attached to a pants leg with the locking clips locked onto the pants material.
Figure 8:
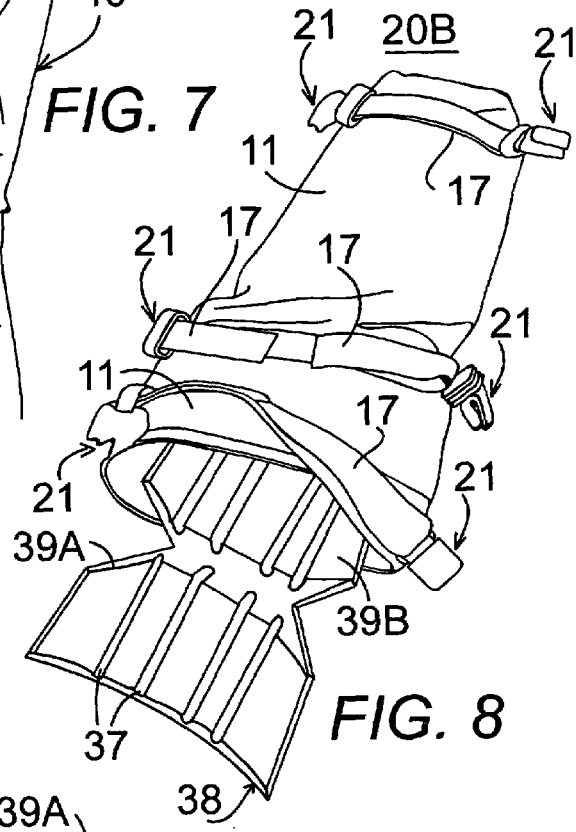
FIG. 8 is a perspective view of the alternate embodiment of FIG. 7 showing the elongated pad being inserted in the sleeve.
Figure 9:
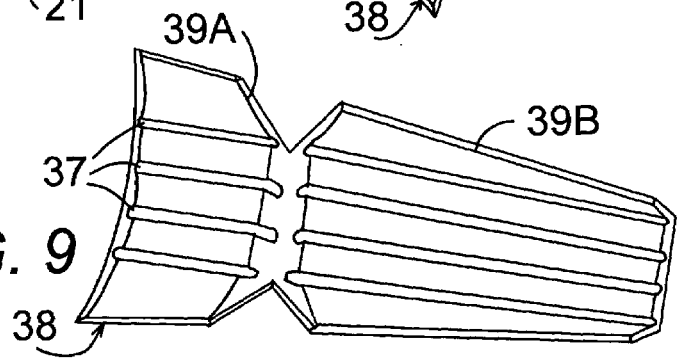
FIG. 9 is a plan view of the elongated pad of the alternate embodiment of FIG. 8.

In FIGS. 7-9, an alternate kneepad device 20B further comprises a bendable insert 39A of padding material, such as a rubberized or dense foam material, inserted in an elongated sleeve 11 of outer rugged fabric, such as canvas or reinforced canvas. The bendable insert has grooves 37 to allow bending and has an upper knee covering portion 39A and a lower shin covering portion 39B of padding material extending from a bottom of the kneepad covering portion 39A for covering a shin of a wearer. The outer sleeve has an upper and lower pair of locking clips 21 positioned above and below the knee as well as an additional pair of locking clips 21 extending from two opposing bottom edges of the elongated sleeve 11. The alternate kneepad device 20B also comprises an adjustable length strap 17 attaching each of the locking clips 21 to the kneepad 27 and further comprises an adjustable length strap 17 attaching each of the locking clips 21 to the sleeve 11. Each of the locking clips 21 of the device 20B may further comprise a strap attaching element 25 attached to the proximal end of the locking clip 21. The strap attaching element 25 has a slot opening 25A therein. The adjustable length strap 17 comprises an elongated strap 17 having a proximal strap end attached to the kneepad 27 and a distal strap end inserted through the slot opening 25A and overlapping itself to form an overlapping section of the elongated strap 17 with a pair of mating hook and loop fasteners attached to the elongated strap 17 for securing the overlapping section of the elongated strap 17 together so that the elongated strap 17 is adjustable to any desired length to form a tight attachment of the kneepad device 20B to the pants 40.

Figure 10:
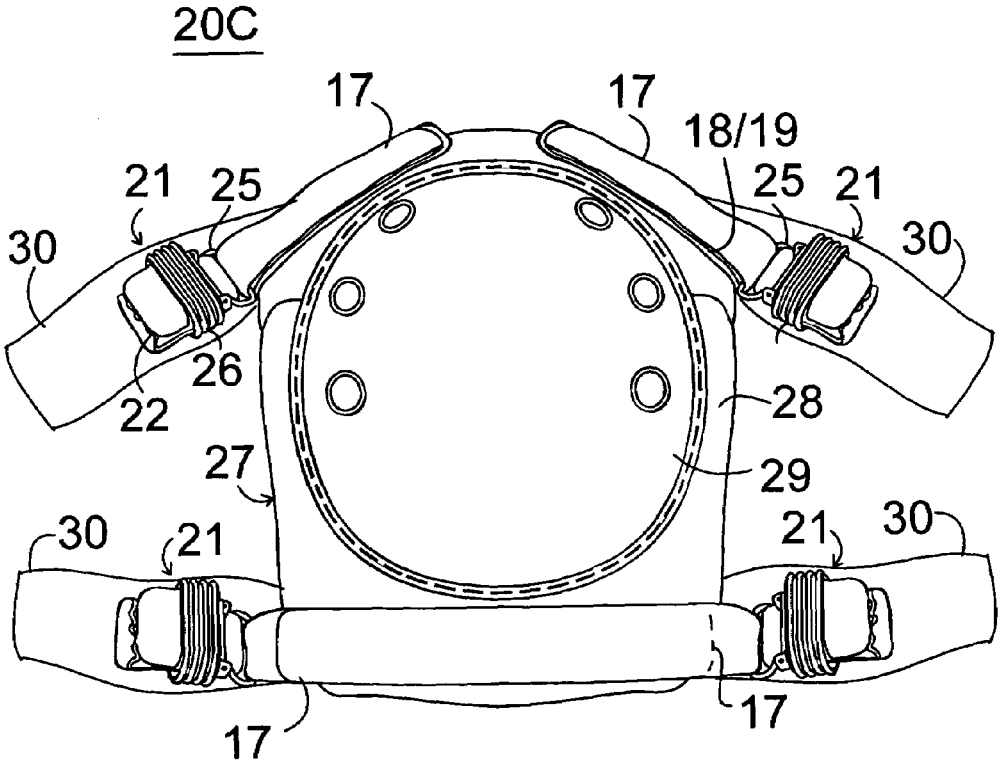
FIG. 10 is a front elevational view of another alternate embodiment of the present invention having a protective cloth of rip-proof material sewn to the kneepads under each of the locking clips so that when the clips are attached to the pants, the protective cloth is between the jaws of the clip and the pants to protect the pants from cutting, or putting holes in the pants.
Figure 11:
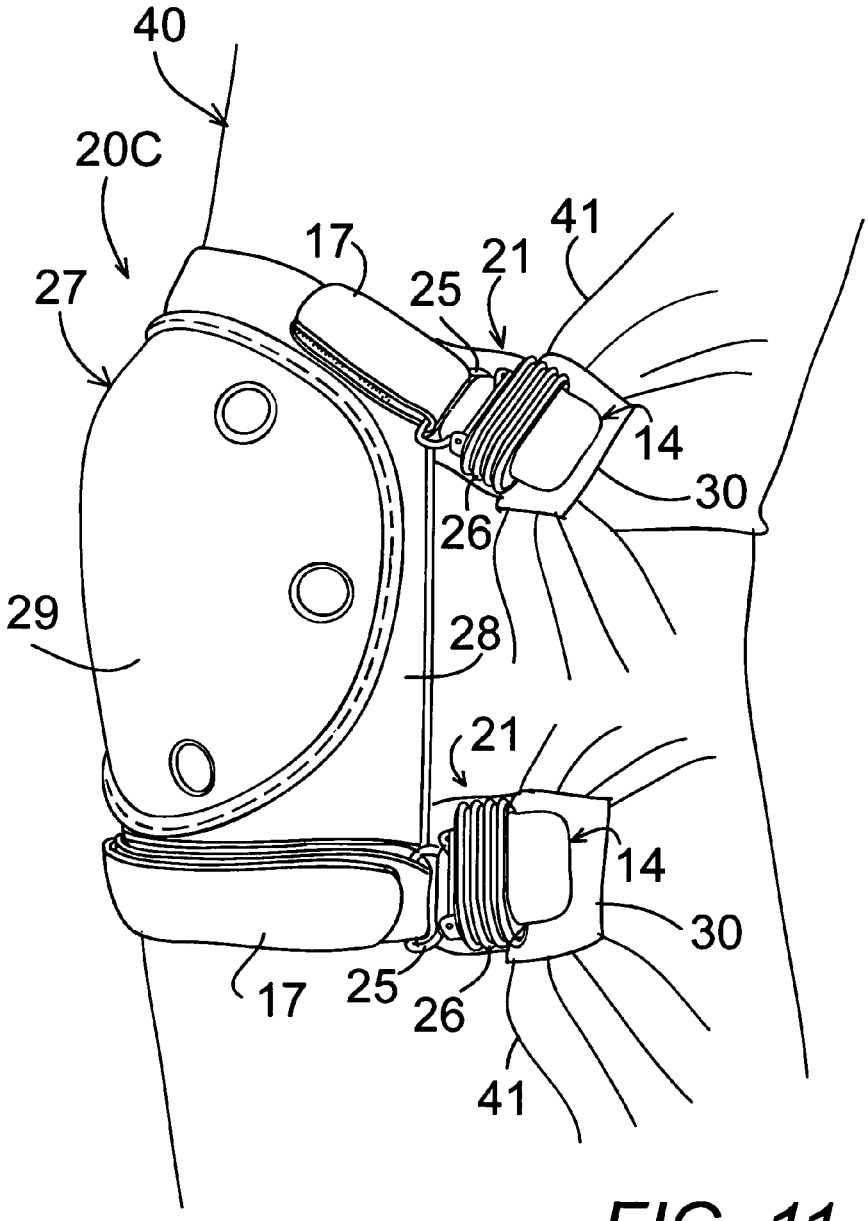
FIG. 11 is a side elevational view of the alternate embodiment of FIG. 6 with the device mounted on the knee of a wearer showing the protective cloth between the jaws of the clips and the pants to protect the pants from cutting, or putting holes in the pants.

In FIGS. 10 and 11, a strip of rip-proof rubber coated protective material 30 is attached to the kneepad under each of the locking clips 21, which rip-proof material 30 fits between the jaws of the locking clips 21 and the pants fabric 41 to insure that the pants fabric does not rip or puncture, as shown in FIG. 11.

Figure 12:
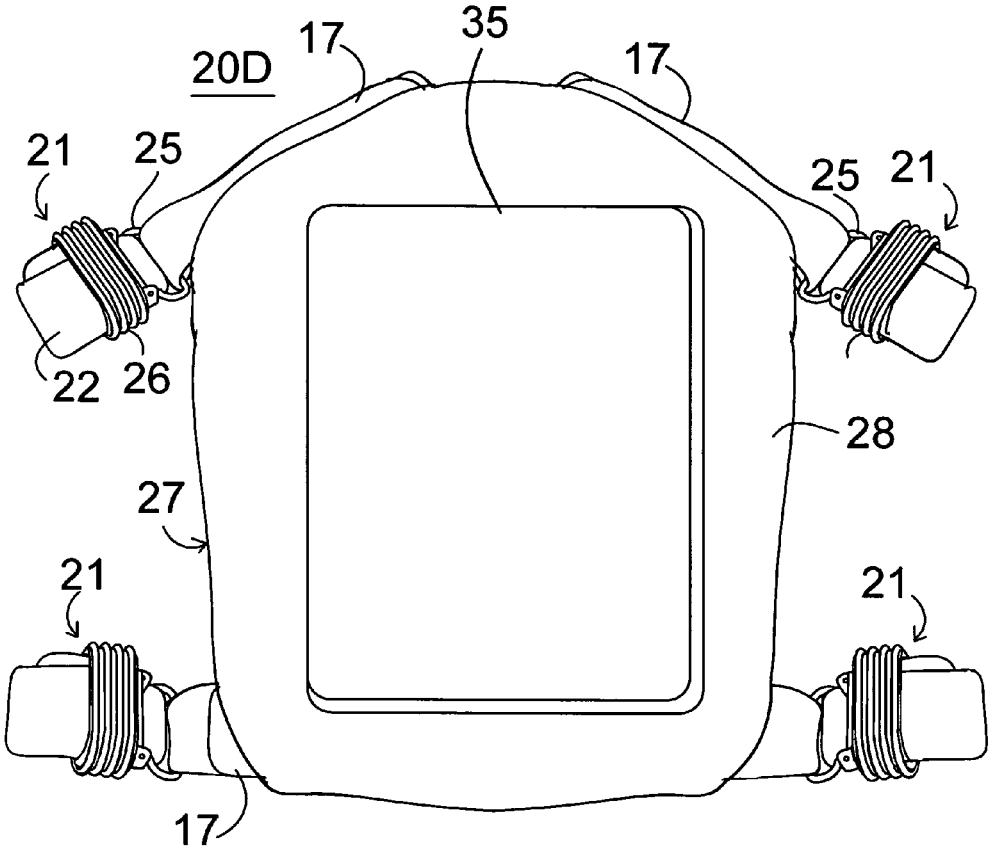
FIG. 12 is a back elevational view of another alternate embodiment of the present invention having a ballistic insert pad of bullet-proof light weight flexible ballistic material shown inserted behind the kneepad.

In FIG. 12, another alternate embodiment of the kneepad device 20D comprises a bullet proof ballistic insert pad 35, preferably fabricated of light weight flexible ballistic materials, inserted behind the kneepad 27 to prevent ballistic penetration to the knee of a wearer.

Figure 14:
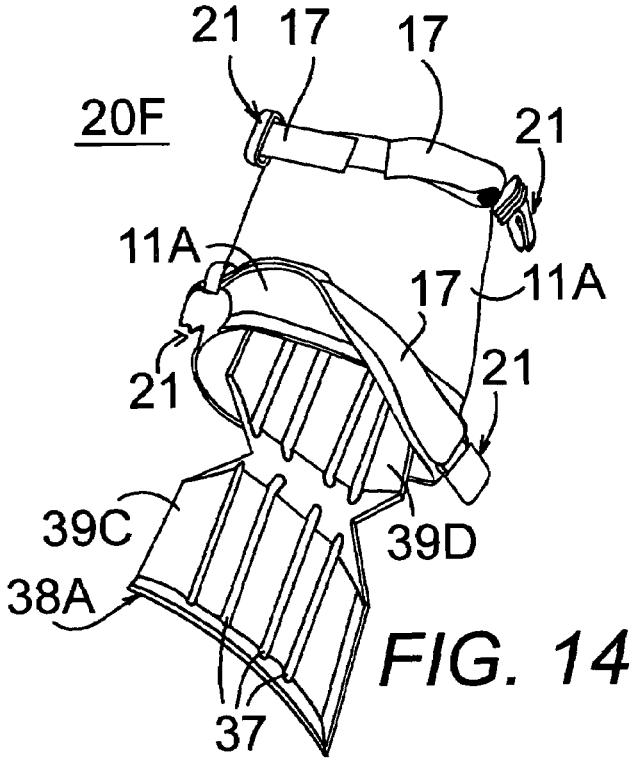
FIG. 14 is a perspective view of another alternate embodiment of the kneepad device of the present invention having a small bendable pad inserted in a short sleeve with top and bottom pairs of locking clips for use either on a knee or an elbow of a wearer, showing the small bendable pad being inserted in the short sleeve.
Figure 15:
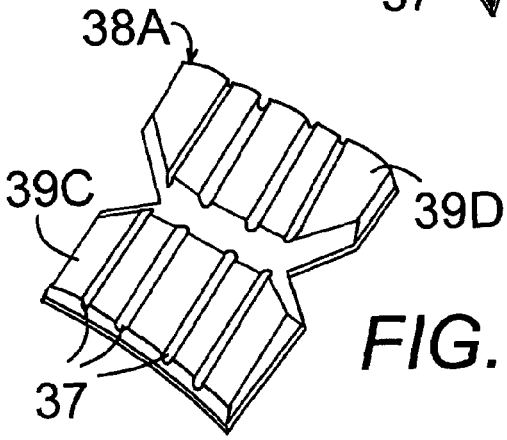
FIG. 15 is a perspective view of the small bendable pad of the alternate embodiment of FIG. 14.

In FIGS. 14 and 15, another alternate embodiment of the kneepad device 20F comprises a small bendable padded material 38A with a top padded section 39C and a bottom padded section 39D interconnected by a thin strip of the material to permit relative bending of the two sections as well as grooves 37 to permit bending around the leg or arm of a wearer. The small bendable padded material is insertable within a short sleeve 11A to form a convertible pad which may be used over the knee of the user or over the elbow of the user with top and bottom pairs of locking clips 21.

Figure 13:
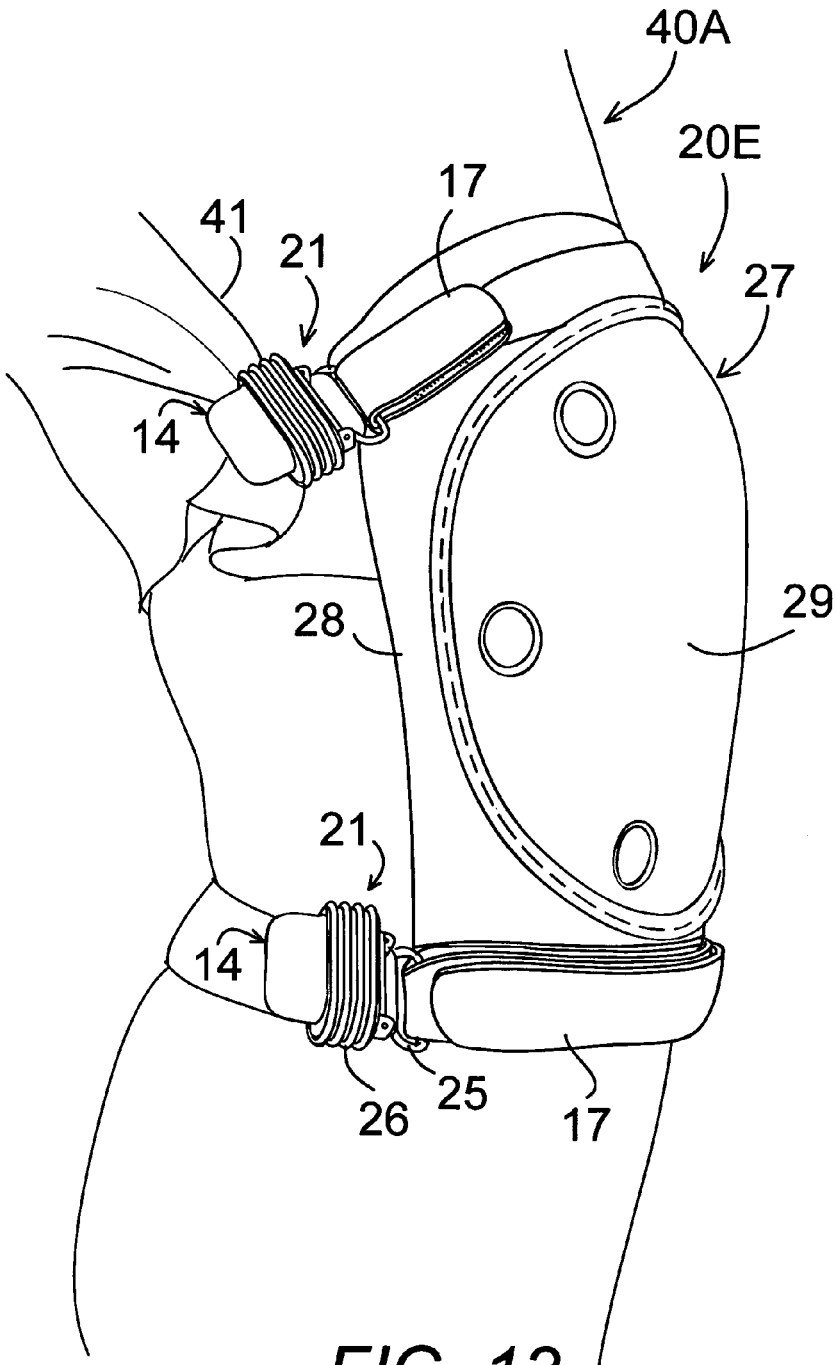
FIG. 13 is a side elevational view of another alternate embodiment of the kneepad device of the present invention having a bottom strap to connect between the two bottom clips so that the bottom strap wraps around the leg of the wearer below the knee with the top clips attached to shorts.

In FIG. 13, another alternate embodiment of the kneepad device 20E comprises a pair of locking clips 21 at the top of the kneepad for engaging material 41 on a pair of shorts 40A worn by the user and a soft leg encircling adjustable bottom strap 34 attached to the bottom locking clips 21 of the kneepad to encircle a bare leg of the user below the knee.

The kneepad device 20 and 20A-20F of the present invention is preferably fabricated of heavy duty materials including ½" thick NEOPRENE rubber inner padding 28 and 28A, a flexible hard rubber cap 29 over the knee stitched down on the inner padding 28 and 28A to prevent debris entry, 1" sturdy canvas straps 17 with mating hook and loop fasteners 18 and 19 sewn or adhered to it, and waterproof nylon material. The kneepad cloth material can be made of any color fabric that may be fire proof, bullet proof, or other qualities necessary for the application. The clip locking loops 26 are preferably made of sturdy molded rubber material, but may be made of hard plastic, cloth material, or any other object around the spring clip 14 to keep it locked closed secured to the pants material 41. The spring loaded clips 14 are made of steel, plastic, or any hard materials and are preferably 1" extra heavy duty spring loaded clips 14 with coated teeth 24 dipped in rubber. An optional extra cover 11 with straps 17, or elastic straps 10 that wrap around the legs 40 can be use as extra holding on the legs 40.

In use, the overlapping sections of the strap 17 on the bottom edge of the kneepad 27 with the hook and loop fasteners 18 and 19 are pulled open first, then the locking clip 21 is positioned on the strap 17 to clip the kneepad 27 to the side fabric 41 of the pants leg 40. Next, make sure upper jaw 23A and the clip control plate 22 of the gripper clip 21 open to the outside. Do this for all four strap points.

Position the pad 27 for best protection of the knee area, then gather the pant material 41 from side of the leg 40 and fasten the spring clip 14 by pressing down on the clip control plate 22 with the jaws 23A and 23B engaging the pants material 41 therebetween and then sliding the clip locking loop 26 over the spring clip 14 to form the combined locking clip 21 and lock it on the material, as shown in FIGS. 4 and 6, to prevent accidental opening. The clip lock loop 26 will keep the metal spring clips 21 positively closed until the user wishes to remove the knee pad devices 20 and 20A-20F. Pull the hook strap 17 over and secure by mating the hook and loop fasteners 18 and 19 for a comfortable fit. Repeat for each side and locking clip 21 of the kneepad 27. The vertical positioning of the kneepad device 20, 20A and 20B may need to be adjusted several times to find the most comfortable position to wear the knee pad 27.

The further the strap 17 is placed around the leg to attach the clips 21 the tighter the straps 17 can be adjusted when the hook strap 17 is reattached to the back on the kneepads 20, 20A and 20B.

Adjusting the straps 17 allows a comfortable fit on both sides 41 of pants 40. The kneepads 20, 20A and 20B should stay in a hanging position without binding or cutting off circulation like other knee pad straps.

Alternately, the knee protection 20E may be worn with knee-length shorts by attaching the top clips 21 to the either side of the shorts leg. An auxiliary strip of material 34 is then used on the back of the leg to attach the bottom clips 21 on each side of the auxiliary strip. The auxiliary strip of material may be made from any comfortable material available.

The lock on kneepads 20 and 20A-20F of the present invention can used by almost everyone, including construction workers, soldiers, police tactical officers and those involved in intense tactical training.

It is understood that the preceding description is given merely by way of illustration and not in limitation of the invention and that various modifications may be made thereto without departing from the spirit of the invention as claimed.

What is claimed is:

1. A kneepad device with locking clips which attach to the sides of pant leg fabric to lock the kneepad device in place on the pant leg, the device comprising:

a kneepad structured to fit over a knee of a wearer to protect the knee;

a locking clip extending from each of two opposing top edges of the kneepad and a locking clip extending from each of two opposing bottom edges of the kneepad, each of the locking clips comprising a clip comprising a pair of jaws pivotally attached together at a proximal end, the jaws each having a means for engaging pants material at a distal end so that the jaws are pivotable together in a closed position with the jaws of the locking clips engaging pants material on each side of a pants leg above a knee of a user and engaging pants material on each side of a pants leg below a knee of a user, and a clip locking loop slidably attached to each of the clips, the clip locking loop having a high friction outer surface, the clip locking loop configured to slide over the pair of jaws of the clip with the pair of jaws in the closed position engaging the pants material to lock the jaws closed over the material to form a locking clip to lock the kneepad onto the pants.

2. The kneepad device of claim 1 further comprising an adjustable length strap attaching each of the locking clips to the kneepad.

3. The kneepad device of claim 2 wherein each of the locking clips further comprises a strap attaching element attached to the proximal end of the locking clip, the strap attaching element having a slot opening therein and the adjustable length strap comprises an elongated strap having a proximal strap end attached to the kneepad and a distal strap end inserted through the slot opening and overlapping itself to form an overlapping section of the elongated strap with a pair of mating hook and loop fasteners attached to the elongated strap for securing the overlapping section of the elongated strap together so that the elongated strap is adjustable to any desired length to form a tight attachment of the kneepad device to the pants.

4. The kneepad device of claim 1 wherein each of the locking clips comprises a pair of offset jaws coated with a rubberized material to create a high friction surface to prevent slippage with the pants material and with smooth rounded edges to prevent tearing the pants material.

5. The kneepad device of claim 4 wherein the means for engaging pants material comprises an array of teeth extending orthogonally from a distal end of one of the pair of jaws misaligned and overlapping with an array of teeth extending orthogonally from the distal end of the other of the pair of jaws with the teeth of the pair of jaws overlapping each other in close proximity in the closed position so that the overlapping teeth grip the pants material with a tight friction fit without piercing the pants material.

6. The kneepad device of claim 5 wherein the clip comprises a spring loaded clip with overlapping rubber coated teeth.

7. The kneepad device of claim 1 wherein the clip locking loop comprises a closed loop of strong material coated with at least an outer resilient rubberized high friction surface, the loop having an inner perimeter mating with and slightly smaller than the outer perimeter of the locking clip so that the outer resilient rubberized surface stretches to enable the clip locking loop to slide over the locking clip and to remain around the locking clip with a high tension fit enhanced by the high friction surface to secure the clip locking loop around the locking clip.

8. The kneepad device of claim 1 wherein the locking loop comprises an oval loop coated with a rubberized surface and having a series of ridges inside the loop to engage the clip and a series of ridges outside the loop for gripping to move the clip locking loop to lock and unlock the clip.

9. The kneepad device of claim 1 wherein the kneepad comprises a large padded underside in contact with the pants of the wearer and a smaller hard outer shell with some flexibility covering just the kneecap for full kneecap protection in a flexible knee pad.

10. The kneepad device of claim 1 wherein the kneepad further comprises a shin padding material extending from a bottom of the kneepad for covering a shin of a wearer and further comprising at least one additional pair of locking clips extending from two opposing bottom edges of the shin padding material.

11. The kneepad device of claim 10 wherein kneepad comprises an elongated sleeve of fabric extending from above the knee down over the shin of the user and an elongated strip of padding material inserted within the elongated sleeve.

12. The kneepad device of claim 11 further comprising an adjustable length strap attaching each of the additional locking clips to the elongated sleeve.

13. The kneepad device of claim 12 wherein each of the locking clips further comprises a strap attaching element attached to the proximal end of the locking clip, the strap attaching element having a slot opening therein and the adjustable length strap comprises an elongated strap having a proximal strap end attached to the kneepad and a distal strap end inserted through the slot opening and overlapping itself to form an overlapping section of the elongated strap with a pair of mating hook and loop fasteners attached to the elongated strap for securing the overlapping section of the elongated strap together so that the elongated strap is adjustable to any desired length to form a tight attachment of the kneepad device to the pants.

14. The kneepad device of claim 1 further comprising a covering strip of material loosely encircling a leg of a user over each of the pair of locking clips to shield the locking clips.

15. The kneepad device of claim 14 wherein each covering strip of material comprises a two-part overlapping strip of material extending from each of two opposing sides of the kneepad and interconnected by mating hook and loop fasteners.

16. The kneepad device of claim 1 further comprising a strip of rip-proof protective material attached to the kneepad under each of the locking clips which rip-proof protective material fits between the jaws of the locking clips and the pants fabric to insure that the pants fabric does not rip or puncture.

17. The kneepad device of claim 1 further comprising a bullet proof pad inserted behind the kneepad to prevent ballistic penetration to the knee of a wearer.

18. The kneepad device of claim 1 wherein the kneepad comprises a small insertable padded material insertable within a short sleeve to form a convertible pad which may be used alternately over the knee of the user and over the elbow of the user.

19. The kneepad device of claim 1 wherein the kneepad comprises a pair of locking clips at the top of the kneepad for engaging material on a pair of shorts worn by the user and a soft leg encircling adjustable bottom strap attached to a pair of locking clips on the bottom of the kneepad to encircle a bare leg of the user below the knee.

* * * * *